US009200579B2

(12) United States Patent
Troebst

(10) Patent No.: US 9,200,579 B2
(45) Date of Patent: Dec. 1, 2015

(54) MOTOR VEHICLE WITH REDUCED SOUND EMISSIONS

(71) Applicant: MAN Truck & Bus AG, Munich (DE)

(72) Inventor: Steffen Troebst, Waldeck (DE)

(73) Assignee: MAN TRUCK & BUS AG, Munich (DE)

( * ) Notice: Subject to any disclaimer, the term of this patent is extended or adjusted under 35 U.S.C. 154(b) by 336 days.

(21) Appl. No.: 13/790,153

(22) Filed: Mar. 8, 2013

(65) Prior Publication Data

US 2013/0238220 A1 Sep. 12, 2013

(30) Foreign Application Priority Data

Mar. 9, 2012 (DE) ..... 10 2012 004 585

(51) Int. Cl.

| | |
|---|---|
| ***F02D 41/14*** | (2006.01) |
| ***F02D 41/40*** | (2006.01) |
| ***F02D 41/04*** | (2006.01) |
| ***F02D 41/24*** | (2006.01) |
| *F02D 31/00* | (2006.01) |
| *F02D 41/02* | (2006.01) |
| *F02D 41/38* | (2006.01) |

(52) U.S. Cl.

CPC ..... *F02D 41/04* (2013.01); *F02D 31/007* (2013.01); *F02D 41/1448* (2013.01); *F02D 41/2422* (2013.01); *F02D 41/401* (2013.01); *F02D 41/402* (2013.01); *F02D 31/009* (2013.01); *F02D 41/027* (2013.01); *F02D 41/3836* (2013.01); *F02D 2200/604* (2013.01); *F02D 2200/701* (2013.01); *F02D 2250/22* (2013.01)

(58) Field of Classification Search

CPC ..... F02D 41/2422; F02D 41/04; F02D 41/10; F02D 41/38; F02D 41/1448; F02D 41/3836; F02D 41/3827; F02D 401/405; F02D 31/007; F02D 31/009; F02D 2200/701; F02D 2200/604; F02D 2250/22

USPC ..... 123/458, 488, 478; 701/102–105

See application file for complete search history.

(56) References Cited

U.S. PATENT DOCUMENTS

| | | | | |
|---|---|---|---|---|
| 6,606,974 | B1 * | 8/2003 | Duffy et al. | 123/299 |
| 2001/0032459 | A1 * | 10/2001 | Hirota et al. | 60/297 |
| 2002/0155039 | A1 * | 10/2002 | Itoh et al. | 422/171 |
| 2004/0073357 | A1 * | 4/2004 | Schliep et al. | 701/117 |
| 2007/0028889 | A1 * | 2/2007 | Ogawa et al. | 123/295 |
| 2007/0089704 | A1 * | 4/2007 | Jacobsson et al. | 123/299 |

* cited by examiner

*Primary Examiner* — Lindsay Low
*Assistant Examiner* — George Jin
(74) *Attorney, Agent, or Firm* — Lucas & Mercanti, LLP

(57) ABSTRACT

A heavy goods vehicle or omnibus motor vehicle with reduced sound emissions, having a diesel engine, the operation of which can be regulated by an injection pump by an engine electronics unit which includes a microprocessor, a data and program store and input and output peripherals. Measures for at least temporarily reducing the sound emissions by the engine can be carded out to and/or at a level preferably prescribed by legislation, by regulating operation of the engine such that free and/or additional data storage locations that need to be provided in the engine electronics unit switch to a reduced-noise mode, the effect of which at least temporarily increases consumption and at the same time is at least approximately constant in terms of power and rotation speed, and which reduces the emission of sound from the drive and/or engine, in particular the reduced-noise mode lowers the rail pressure, defers the injection to a later time and/or provides a greater volume of subsets in the fuel metering.

25 Claims, 1 Drawing Sheet

MOTOR VEHICLE WITH REDUCED SOUND EMISSIONS

CROSS-REFERENCE TO RELATED APPLICATIONS

This application claims the priority of DE 10 2012 004 585.9 filed Mar. 9, 2012, which is incorporated by reference herein.

BACKGROUND OF THE INVENTION

1. Field of the Invention

The invention relates to a motor vehicle, particularly a heavy goods vehicle or omnibus, with reduced sound emissions, having an engine, particularly a diesel engine, the operation of which can be regulated by means of an injection pump by an engine electronics unit which comprises a microprocessor, a data and program store and input and output peripherals, and hence measures for at least temporarily reducing the sound emissions by the engine and/or the vehicle can be carried out to and/or at a level preferably prescribed by legislation.

2. Description of Prior Art

The laid-open specification DE 2006 026 614 A1 describes dynamics management for the drive train, in which, for the purpose of regulating the operating behaviour of a diesel engine in a motor vehicle, in which a vehicle guidance computer regulates an electronic fuel injection on the basis of the engine rotation speed. The acceleration of the engine rotation speed is regulated by a family of characteristic curves that has been programmed into the vehicle guidance computer and that allocates the setpoint values for the rotation speed acceleration, the engine rotation speed and the vehicle speed in relation to one another. This makes it possible for the rotation speed acceleration of the engine to be limited on the basis of speed and rotation speed by means of a family of characteristic curves. The setpoint values for the individual parameters rotation speed acceleration, engine rotation speed and vehicle speed are transmitted to the engine controller and, therein, result in engine acceleration which is appropriate to the respective loading state and which corresponds to the desired dynamic response.

The laid-open specification EP 545 027 A1 also teaches a low-noise motor vehicle, particularly a heavy goods vehicle or omnibus, in which the reduction/limiting of the noise emissions by the engine can be accomplished by regulating the operation thereof. To this end, the values from different full-load lines and speed-regulation lines, which are at least partially different from those from the standard full-load line and speed-regulation line, in the engine electronics unit are step in. The values taken from the full-load line and/or speed-regulation line are used for adjusting the injection pump for the purpose of reduced-noise operation of the engine, with free or additionally providable data storage locations in the engine electronics unit storing the values from full-load lines and speed-regulation lines with reduced power and rotation speed.

SUMMARY OF THE INVENTION

The present invention is based on the object of reducing the sound emissions by a vehicle and at the same time ensuring greater safety for the vehicle in road traffic. In addition, it is an object of the invention to keep the power or rotation speed of the engine in a motor vehicle constant despite at least temporarily reduced sound emission from the motor vehicle and to increase the safety of the vehicle.

This objects are achieved in that a reduction in the sound emissions by the engine can be carried out by measures concerning the regulation of operation thereof such that free and/or additional data storage locations that need to be provided in the engine electronics unit switch to a reduced-noise mode, the effect of which at least temporarily increases consumption and at the same time is at least constant in terms of power and rotation speed, and which reduces the emission of sound from the drive and/or engine. In particular, the reduced-noise mode lowers the rail pressure, defers the injection to a later time and/or provides a greater volume of subsets in the fuel metering. A fundamental point of the invention is that it has been recognized that noise reduction cannot necessarily be accomplished by power reduction, but rather it is also necessary to carry out an at least temporarily, or, in particular, a brief, reduced-noise mode at at least the same power and rotation speed and with accompanying increased fuel consumption. Particularly in the case of ascents and/or in the case of overtaking manoeuvres, power reduction—as is constantly described in the prior art—to reduce the sound emissions by the motor vehicle could create a situation that is dangerous to the driver of the motor vehicle, since, during the overtaking manoeuvre, for example, the driver of the vehicle continues to be denied the expected power and the overtaking manoeuvre takes a longer period and possibly needs to be aborted. By way of example, for particular scenarios in which noise reduction in the engine is desirable (e.g. scenarios which are ascertained using GPS data, acceleration data or the like), increased fuel consumption over a limited, preferably short period could be feasible and/or advantageous.

DETAILED DESCRIPTION OF THE PREFERRED EMBODIMENTS

Figure 1:
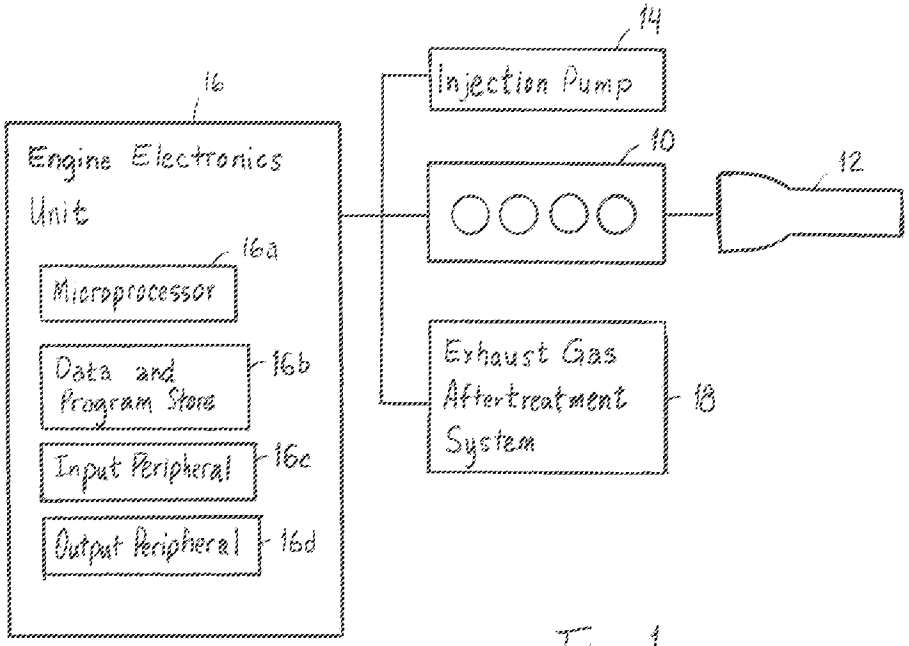
FIG. 1 is a schematic block diagram of a motor vehicle according to an embodiment of the present invention.

According to FIG. 1, an embodiment of the invention includes motor vehicle with reduced sound emissions. The motor vehicle includes an engine 10 and a drive 12, an injection pump 14, and an exhaust gas aftertreatment system 18. An engine electronics unit 16 comprises a microprocessor 16*a*, a data and program store 16*b*, an input and output peripherals 16*c*, 16*d*. A regulation of an operation of the engine 10 is performed by the injection pump 14 and by the engine electronics unit 16. The engine electronics unit 16 is switchable between a normal mode and a reduced noise mode, wherein free or additional data store areas are used by the engine electronics unit in the reduced-noise mode in which at least one of a rail pressure is lowered, injection is deferred to a later time, and a greater volume of subsets is provided in fuel metering, compared to the normal mode, the effect of which at least temporarily increases consumption while at the same time maintains at least approximately constant power and rotation speed, and reduces the emission of sound from the drive and/or engine in the reduces-noise mode.

In addition, it has been found to be particularly advantageous if before and/or during the reduced-noise mode a state of an exhaust-gas aftertreatment system is polled and, in particular when there is a decline in the conversion rates of the catalytic converter and/or when a fill-level limit value, in particular indicated by the exhaust-gas back-pressure, for the particle filter is exceeded, the mode changes back to the normal mode and/or remains in the normal mode.

This measure ensures that, despite noise reduction being attempted, it is not performed if the exhaust-gas aftertreatment system is not ready to "handle" increased quantities of exhaust gas. Hence, any adverse effects of the reduced-noise mode on the exhaust-gas aftertreatment system on account of the at least constant power and rotation speed can be prevented.

By way of example, the limit values that can be used for this could be in the form that the decline in the conversion rate of the catalytic converter is between 10 and 50%, preferably between 12 and 15%, and/or the fill level limit value, in particular indicated by the exhaust-gas back-pressure, for the particle filter is between 60 and 400 mbar, preferably between 150 and 250 mbar. The temporary noise reduction can influence the fuel consumption and/or the exhaust-gas emission for this period.

According to a further refinement of the invention, in the reduced-noise mode the pre-injection quantity is raised in comparison with the normal mode and/or in the reduced-noise mode the exhaust-gas recirculation is opened and/or is open to a greater extent than in a normal mode. The latter results in the exhaust-gas recirculation rate being maintained or increased. Opening the exhaust-gas recirculation to a greater extent is understood to mean increasing the exhaust-gas recirculation rate as for comparable operating parameters in the normal mode.

In addition, it has been found to be advantageous if the reduced-noise mode starts

- on the basis of a predefined rotation speed value in the range of 33 to 90% of the nominal rotation speed of the engine,
- on the basis of a threshold value detected at a microphone on the motor vehicle being exceeded,
- on the basis of an actual-speed or actual-acceleration threshold value being exceeded and/or
- on the basis of a limit range for gearbox speed and engine rotation speed being exceeded and/or
- a combination of two or more of the aforementioned events.

Particularly orientation to a predefined rotation speed value in the range of 33 to 90% of the nominal rotation speed of the engine is advantageous in this case. The triggering of the reduced-noise mode when at least one of the aforementioned events occurs is intended to "cap" the noise peaks in deliberate fashion.

Values which may be assumed for the actual-speed threshold value for heavy goods vehicles and/or motor cars are between 30 and 70 km/h, preferably between 39 and 61 km/h. Alternatively or in addition, the limit range used for the gear ratio may be greater than 2 to 1 or less than 6 to 1.

In connection with the events and conditions for instigating the reduced-noise mode which are described in the paragraphs above, it is additionally possible to factor in a dependency on the loading of the vehicle besides the acceleration threshold values. The loading of the vehicle can be ascertained using the shock-absorber response, one or more load cells, by an input from the driver and/or by inferring the operating behaviour of the HGV in the normal state (e.g. using acceleration sensors).

For the design of the periods of the reduced-sound mode phases, it has been found to be advantageous if between two low-noise mode phases there is at least a period of 5 minutes, preferably at least a period of 2 minutes, particularly preferably a period of at least 30 seconds, in which the vehicle is operated in normal mode. This is a forced break between two successive low-noise mode phases.

In a further advantageous refinement of the invention, a first degree of sound reduction is carried out during the low-noise mode if the vehicle is in a first surface section and a second degree of sound reduction is carried out during the low-noise mode if the motor vehicle is in a second surface section, the first and second degrees of sound reduction being different, in particular having at least a delta of 3 dB sound pressure at a measurement interval chosen on a defined basis. A first and a second degree of sound reduction mean more or less a low-noise mode A and a low-noise mode B, during the respective mode phases of which the sound emission by the motor vehicle is reduced in comparison with the normal mode and wherein the low-noise mode A and the low-noise mode B differ from one another by means of a delta of at least 3 dB in respect of the sound emissions thereof. The surface section used may be quadrants of a map and/or sections of a GPS map system. Alternatively, the motor vehicle can also recognize and associate/classify the surface sections as urban and extra-urban, for example, by scanning place-name signs and/or the type of surroundings (building and/or scenic surroundings). As a result of the association of the current location of the vehicle with urban and extra-urban, for example, it is possible to take this as basis for activating a lower-noise mode in an urban environment and just a low-noise mode in an extra-urban environment. This approach may be owing either to the relatively high noise avoidance aim or to the relatively high noise reflection aspect of the respective location. For example, sound will propagate to a much greater extent in a built-up urban area, or the sound will be subjectively more distinctively perceptible.

In addition, provision may be made for at least one first threshold value to be used for instigating at least a low-noise mode when the motor vehicle is in a first surface section and for a second threshold value to be used for instigating at least a low-noise mode when the motor vehicle is not in a surface section, the first and second threshold values being different. Hence, besides the difference described in the preceding paragraph for the noise emissions within reduced-noise mode A and reduced-noise mode B, it is also possible for the initiation and instigation of a low-noise mode and/or a particular low-noise mode to be made dependent on a piece of location information and hence information concerning whether the motor vehicle is in a first or a second surface section. By way of example, the location information relates to an association of the vehicle location with an urban or heavily built-up area or with a rural or little built-up area.

The presence of the motor vehicle in a first or second or further surface section can be ascertained and/or stipulated by a GPS system, a locating system, an optical system, a vehicle communication system, a mobile radio, a smartphone, a broadcast radio system, a radar system, an infrared system, a map system and/or by a manual input from the driver.

The optical system can advantageously detect buildings, landscapes, road signs and/or moving objects in the environment of the vehicle and, on the basis of these detected objects, can select and associate one of at least two different surroundings categories, with the degree of sound reduction and/or the threshold value for instigation of the reduced-noise mode varying on the basis of the selected or associated surroundings categories. By way of example, pedestrians or other road users are detected in the surroundings of the vehicle, as a result of which a need to instigate the reduced-sound mode can be deduced therefrom. Hence, the initiation could be made dependent on potential noise receivers in the surroundings of the vehicle.

It is a further advantageous measure if the degree of sound reduction and/or the threshold value for instigation of the reduced-noise mode varies on the basis of the values from a rain sensor on the vehicle and/or on the basis of the associated weather conditions at the location of the vehicle and/or on the basis of the weather information detected by an optical sensor and/or on the basis of the sound reflection properties of the surroundings and particularly of the carriageway. By way of example, on a wet road, which is distinguished by an increased degree of sound reflection, inter alia, it may be advantageous for earlier and/or for a mode phase with "enhanced" sound reduction to be instigated. Hence, in this advantageous embodiment, the "acoustic conditions" prevailing outside the vehicle (reflection properties of the surroundings) are taken as a basis for customizing the reduced-noise mode (starting threshold value, degree of noise reduction, mode duration).

The subject matter of the invention extends not just to a motor vehicle as described in concrete terms but also generally to a method for influencing the sound emissions from a motor vehicle having the aforementioned features.

The invention claimed is:

1. A motor vehicle with reduced sound emissions, comprising:

an engine and a drive;

an injection pump; and an engine electronics unit which comprises a microprocessor, a data and program store and input and output peripherals, wherein a regulation of an operation of the engine is performed by the injection pump and by the engine electronics unit, and the engine electronics unit being switchable between a normal mode and a reduced noise mode, wherein free or additional data store areas are used by the engine electronics unit in the reduced-noise mode in which at least one of a rail pressure is lowered, injection is deferred to a later time, and a greater volume of subsets is provided in fuel metering, compared to the normal mode, the effect of which at least temporarily increases consumption while at the same time maintains at least approximately constant power and rotation speed, and reduces the emission of sound from the drive and/or engine in the reduced-noise mode, wherein the engine electronics unit carries out a first degree of sound reduction during the reduced-noise mode if the vehicle is in a first surface section and carries out a second degree of sound reduction during the reduced-noise mode if the motor vehicle is in a second surface section, the first and second degrees of sound reduction being different and having at least a delta of 3 dB sound pressure at the chosen measurement interval.

2. The motor vehicle with reduced sound emissions according to claim 1, wherein the reduced-noise mode lasts for a maximum period of 5 minutes and subsequently changes back to a normal mode.

3. The motor vehicle with reduced sound emissions according to claim 1, wherein the engine control unit is configured to poll a state of an exhaust-gas aftertreatment system before or during the reduced-noise mode and, in particular when one of a decline in the conversion rates of the catalytic converter and a fill-level limit value for the particle filter, indicated by the exhaust-gas back-pressure, is exceeded, the engine control unit changes back to the normal mode and/or remains in the normal mode.

4. The motor vehicle with reduced sound emissions according to claim 3, wherein the decline in the conversion rates of the catalytic converter is between 10 and 50%, and/or the fill level limit value indicated by the exhaust-gas back-pressure is between 60 and 400 mbar.

5. The motor vehicle with reduced sound emissions according to claim 1, wherein in the reduced-noise mode the pre-injection quantity is raised in comparison with the normal mode and/or in that in the reduced-noise mode the exhaust-gas recirculation rate is maintained or increased in comparison with the normal mode.

6. The motor vehicle with reduced sound emissions according to claim 1, wherein the reduced-noise mode starts on the basis of one of a predefined rotation speed value in the range of 33 to 90% of the nominal rotation speed of the engine, a threshold value detected at a microphone on the motor vehicle being exceeded, an actual-speed and/or actual-acceleration threshold value being exceeded, a limit range for gearbox speed and engine rotation speed being exceeded and a combination of two or more of the aforementioned events.

7. The motor vehicle with reduced sound emissions according to claim 6, wherein the actual-speed threshold value for heavy goods vehicles is between 30 and 70 km/h and in that the limit range of the gear ratio is greater than 2:1 and less than 6:1.

8. The motor vehicle with reduced sound emissions according to claim 6, wherein the acceleration threshold value is dependent on a loading of the vehicle.

9. The motor vehicle with reduced sound emissions according to claim 1, wherein the engine electronics unit is configured to wait at least a period of 5 minutes between two successive low-noise mode phases.

10. The motor vehicle with reduced sound emissions according to claim 1, wherein the engine electronics unit carries out a first degree of sound reduction out during the reduced-noise mode if the vehicle is in a first surface section and a second degree of sound reduction during the reduced-noise mode if the motor vehicle is in a second surface section, the first and second degrees of sound reduction being different and having at least a delta of 3 dB sound pressure at the chosen measurement interval.

11. The motor vehicle with reduced sound emissions according to claim 1, wherein at least one first threshold value is used for instigating at least a low-noise mode when the motor vehicle is in a first surface section and a second threshold value is used for instigating at least a low-noise mode when the motor vehicle is in a second surface section, the first and second threshold values being different.

12. The motor vehicle with reduced sound emissions according to claim 1, wherein a presence of the motor vehicle in the first surface section, the second surface section or a further surface section is determined or stipulated by one of a GPS system, a locating system, an optical system, a vehicle communication system, a mobile radio, a smartphone, a broadcast radio system, a radar system, an infrared system, a map system and by a manual input by a driver.

13. The motor vehicle with reduced sound emissions according to claim 12, further comprising the optical system, wherein the optical system is configured to detect buildings, landscapes, road signs and/or moving objects in the environment of the vehicle and, on the basis of these detected objects, selects one of at least two different surroundings categories, the selected surroundings category being taken as a basis for varying the degree of sound reduction and/or the threshold value for instigating the reduced-noise mode.

14. The motor vehicle with reduced sound emissions according to claim 1, wherein at least one of a degree of sound reduction and the threshold value for instigation of the reduced-noise mode varies on the basis of one of:

values from a weather, moisture or rain sensor on the vehicle;

weather conditions associated with the location of the vehicle; and weather information detected by an optical sensor.

15. The motor vehicle with reduced sound emissions according to claim 1, wherein the reduced-noise mode lasts for a maximum period of 2 minutes and subsequently changes back to a normal mode.

16. The motor vehicle with reduced sound emissions according to claim 1, wherein the reduced-noise mode lasts for a maximum period of 40 seconds and subsequently changes back to a normal mode.

17. The motor vehicle with reduced sound emissions according to claim 3, wherein the decline in the conversion rates of the catalytic converter is between 12 and 15%.

18. A motor vehicle with reduced sound emissions, comprising:

an engine and a drive;

an injection pump; and an engine electronics unit which comprises a microprocessor, a data and program store and input and output peripherals, wherein a regulation of an operation of the engine is performed by the injection pump and by the engine electronics unit, and the engine electronics unit being switchable between a normal mode and a reduced noise mode, wherein free or additional data store areas are used by the engine electronics unit in the reduced-noise mode in which at least one of a rail pressure is lowered, injection is deferred to a later time, and a greater volume of subsets is provided in fuel metering, compared to the normal mode, the effect of which at least temporarily increases consumption while at the same time maintains at least approximately constant power and rotation speed, and reduces the emission of sound from the drive and/or engine in the reduced-noise mode, wherein the engine control unit is configured to poll a state of an exhaust-gas aftertreatment system before or during the reduced-noise mode and, in particular when one of a decline in the conversion rates of the catalytic converter and a fill-level limit value for the particle filter, indicated by the exhaust-gas back-pressure, is exceeded, the engine control unit changes back to the normal mode and/or remains in the normal mode, and wherein the fill level limit value indicated by the exhaust-gas back-pressure is between 150 and 250 mbar.

19. The motor vehicle with reduced sound emissions according to claim 6, wherein the actual-speed threshold value for heavy goods vehicles is between 39 and 61 km/h.

20. The motor vehicle with reduced sound emissions according to claim 6, wherein the limit range of the gear ratio is greater than 2:1 and less than 6:1.

21. The motor vehicle with reduced sound emissions according to claim 1, wherein the engine electronics unit is configured to wait at least a period of 2 minutes between two successive low-noise mode phases.

22. The motor vehicle with reduced sound emissions according to claim 1, wherein the engine electronics unit is configured to wait at least a period of 30 seconds between two successive low-noise mode phases.

23. The motor vehicle with reduced sound emissions according to claim 1, wherein the motor vehicle is a heavy goods vehicle or omnibus and the engine is a diesel engine.

24. A method for influencing the emission of sound by a motor vehicle having a drive and an engine, the operation of which can be regulated using measures for at least temporarily reducing the sound emissions by the engine to or at a level preferably prescribed by legislation, comprising:

switching an engine electronics unit to a reduced-noise mode from a normal mode, and at least one of lowering the rail pressure, deferring the injection to a later time and providing a greater volume of subsets in fuel metering compared to a normal mode, the effect of which increases consumption at least in phases while maintaining at least approximately constant power and rotation speed, and reduces the emission of noise from the drive and/or the engine, wherein a first degree of sound reduction is carried out if the vehicle is in a first surface section and a second degree of sound reduction is carried out if the motor vehicle is in a second surface section, the first and second degrees of sound reduction being different and having at least a delta of 3 dB sound pressure at a chosen measurement interval.

25. A method for influencing the emission of sound by a motor vehicle having a drive and an engine, the operation of which can be regulated using measures for at least temporarily reducing the sound emissions by the engine to or at a level preferably prescribed by legislation, comprising:

switching an engine electronics unit to a reduced-noise mode from a normal mode, and at least one of lowering the rail pressure, deferring the injection to a later time and providing a greater volume of subsets in fuel metering compared to a normal mode, the effect of which increases consumption at least in phases while maintaining at least approximately constant power and rotation speed, and reduces the emission of noise from the drive and/or the engine, polling a state of an exhaust-gas aftertreatment system before or during the reduced-noise mode and, in particular when one of a decline in the conversion rates of the catalytic converter and a fill-level limit value for the particle filter, indicated by the exhaust-gas back-pressure, is exceeded, changing back to the normal mode and/or remaining in the normal mode, wherein the fill level limit value indicated by the exhaust-gas back-pressure is between 150 and 250 mbar.

* * * * *